US008658920B2

(12) United States Patent
Engelhardt et al.

(10) Patent No.: US 8,658,920 B2
(45) Date of Patent: Feb. 25, 2014

(54) SWITCH MODULE SYSTEM

(71) Applicant: Leopold Kostal GmbH & Co. KG, Luedenscheid (DE)

(72) Inventors: Harry Engelhardt, Bochum (DE); Markus Adam, Olpe (DE)

(73) Assignee: Leopold Kostal GmbH & Co. KG, Luedenscheid (DE)

( * ) Notice: Subject to any disclaimer, the term of this patent is extended or adjusted under 35 U.S.C. 154(b) by 0 days.

(21) Appl. No.: 13/644,912

(22) Filed: Oct. 4, 2012

(65) Prior Publication Data

US 2013/0026023 A1 Jan. 31, 2013

Related U.S. Application Data

(63) Continuation of application No. PCT/EP2011/056149, filed on Apr. 18, 2011.

(30) Foreign Application Priority Data

Apr. 21, 2010 (DE) ..... 10 2010 015 728

(51) Int. Cl.
*H01H 13/04* (2006.01)

(52) U.S. Cl.
USPC ..... 200/5 A; 200/345; 200/341; 200/333

(58) Field of Classification Search
USPC ..... 200/333, 345
See application file for complete search history.

(56) References Cited

U.S. PATENT DOCUMENTS

| | | | | |
|---|---|---|---|---|
| 3,900,712 | A * | 8/1975 | Fukao | 200/307 |
| 3,970,812 | A | 7/1976 | Nowack | |
| RE30,435 | E | 11/1980 | Fukao | |
| 7,005,588 | B2 * | 2/2006 | Pihlaja | 200/5 A |
| 7,265,745 | B1 * | 9/2007 | Kling | 345/169 |
| 2009/0160529 | A1 * | 6/2009 | Lamborghini et al. | 327/517 |

FOREIGN PATENT DOCUMENTS

| | | | | |
|---|---|---|---|---|
| DE | 19846450 | * | 4/2000 | H01H 3/705 |
| DE | 19846450 | A1 | 4/2000 | |
| DE | 102006003891 | A1 | 8/2007 | |
| DE | 102008048708 | A1 | 3/2010 | |

OTHER PUBLICATIONS

International Bureau, Patent Cooperation Treaty, International Preliminary Report on Patentability for the corresponding International Application No. PCT/EP2011/056149 mailed Nov. 7, 2012.

* cited by examiner

*Primary Examiner* — Renee Luebke
*Assistant Examiner* — Ahmed Saeed
(74) *Attorney, Agent, or Firm* — Brooks Kushman P.C.

(57) ABSTRACT

A switch module system includes switch modules. Each switch module has a housing, a keypad with switch domes, and an actuator for the switch domes. The housing of each switch module includes a housing chassis and a housing cover. The switch modules are attached to a substrate with contact areas of the substrate being electrically connectable through the switch domes of the keypads of the switch modules. For each switch module a respective section of the substrate is inserted into the housing chassis of the switch module and the respective section of the substrate is attached by the housing cover of the switch module to the housing chassis of the switch module.

16 Claims, 3 Drawing Sheets

SWITCH MODULE SYSTEM

CROSS-REFERENCE TO RELATED APPLICATIONS

This application is a continuation of International Application No. PCT/EP2011/056149, published in German, with an International filing date of Apr. 18, 2011, which claims priority to DE 10 2010 015 728.7, filed Apr. 21, 2010; the disclosures of which are incorporated in their entirety by reference herein.

TECHNICAL FIELD

The present invention relates to a switch module system including at least one switch module having a housing, a keypad having switch domes, and an actuator for the switch domes of the key pad in which the housing is attached to a substrate having contact areas that can be connected to one another through the keypad when the switch domes of the keypad are pressed against the contact areas of the substrate upon the actuator being actuated.

BACKGROUND

DE 198 46 450 A1 describes a switch module system having two switch modules. The first switch module is an electromechanical switch module having a switch. The second switch module is a mechanical switch module having at least one switch actuator. The switch and the at least one switch actuator can be connected to one another. The electromechanical switch module includes a flexible printed circuit board and can have an elastomeric mat. One or more keys belong to the mechanical switch module. This switch module system enables different electromechanical and mechanical switch modules to be combined with one another. Each respective combination has an external housing that can contain one or more switches.

SUMMARY

An object of the present invention includes a switch module system having switch modules with the switch modules having respective housings which are configured to combine the switch modules with one another in a form-fitting manner and which can be attached to a common substrate in order to thereby form the switch module system in an assembled state.

In carrying out at least one of the above and other objects, the present invention provides a switch module system having switch modules. Each switch module has a housing, a keypad with switch domes, and an actuator for the switch domes. The housing of each switch module includes a housing chassis and a housing cover. The switch modules are attached to a substrate with contact areas of the substrate being electrically connectable through the switch domes of the keypads of the switch modules. For each switch module a respective section of the substrate is inserted into the housing chassis of the switch module and the respective section of the substrate is attached by the housing cover of the switch module to the housing chassis of the switch module.

Embodiments of the present invention are directed to a switch module system including at least one switch module and a substrate. The substrate is a circuit carrier such as a flexible or rigid printed circuit board (PCB). Each switch module includes a housing, a keypad having switch domes, and an actuator for the switch domes. The actuator is movable between a depressed position and a released position relative to the housing. The actuator moves to the depressed position upon being pressed (i.e., actuated). Each switch module can be joined to the substrate. In particular, the housings of a plurality of switch modules can be joined to the substrate and can be positively connected to one another. The substrate includes contact areas for each switch module. The contact areas for a switch module are electrically connected together through the switch domes of the keypad of the switch module while the switch domes are in physical contact with the contact areas. The switch domes of the keypad of a switch module become in physical contact with the corresponding contact areas of the substrate upon the actuator of the switch module being actuated to the depressed position. In the depressed position, the actuator of a switch module engages the keypad of the switch module and thereby presses the switch domes of the keypad towards and against the corresponding contact areas of the substrate. These contact areas physically touching against the corresponding switch domes of the keypad are thereby electrically connected to one another through the switch domes by the keypad.

The individual switch modules of a switch module system in accordance with embodiments of the present invention can be clipped or screwed onto the substrate. For this purpose, for each switch module, a respective section of the substrate is insertable into the housing chassis of the housing of the switch module and the section of the substrate is attachable by another housing part of the housing of the switch module to the housing chassis of the housing of the switch module. This other housing part can be formed as an external surface of a housing cover that seals the housing chassis.

For a simple mounting procedure, the housing cover is integrally molded to the housing chassis by a film hinge such that the housing cover is connected inseparably to the housing chassis.

As described, a switch module system in accordance with embodiments of the present invention includes a plurality of switch modules with each switch module corresponding to an individual switch. The switch modules respectively have a simple design and can be mechanically and electrically joined in a particularly simple and cost effective manner. Different applications require switch panels that include a plurality of similar individual switches whose number and design can be preset respectively in an application specific manner. A switch module system in accordance with embodiments of the present invention satisfies provides such capabilities.

The above features, and other features and advantages of the present invention are readily apparent from the following detailed description thereof when taken in connection with the accompanying drawings. It is understood that the features stated above and to be explained below may be used not only in the particular stated combination, but also in other combinations or alone without departing from the scope of the present invention.

DETAILED DESCRIPTION

Detailed embodiments of the present invention are disclosed herein; however, it is to be understood that the disclosed embodiments are merely exemplary of the present invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
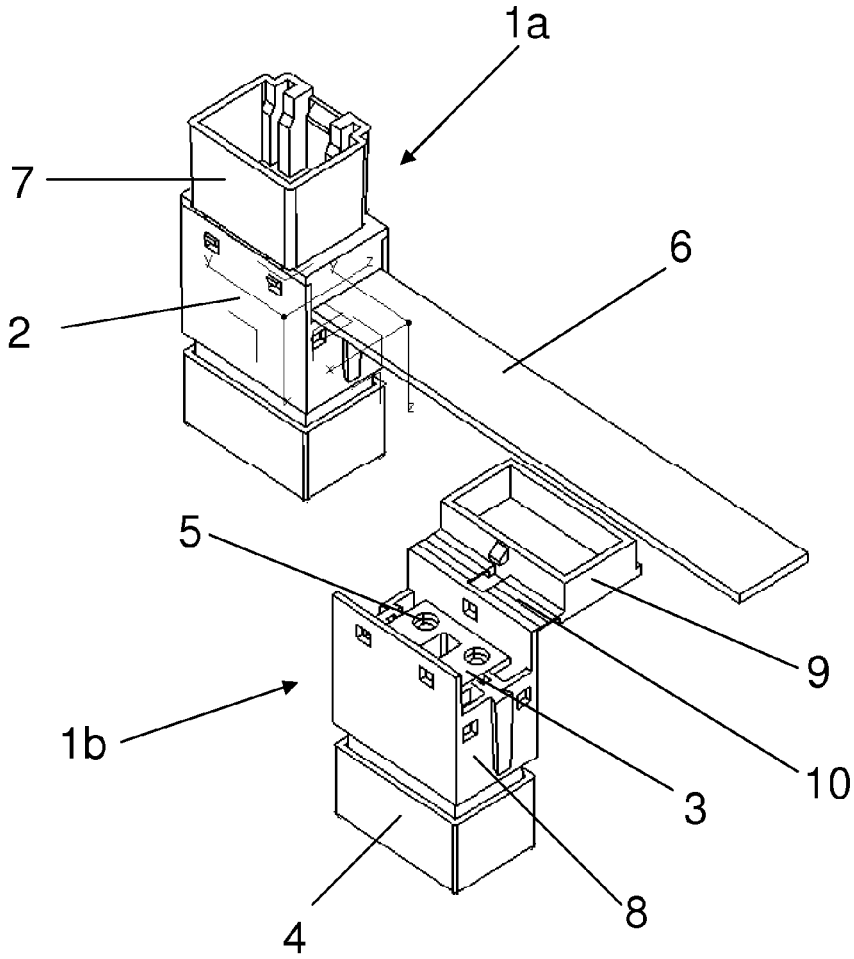
FIG. 1 illustrates a switch module system having two switch modules in accordance with an embodiment of the present invention in which the switch module system is in a first stage of assembly.
Figure 2:
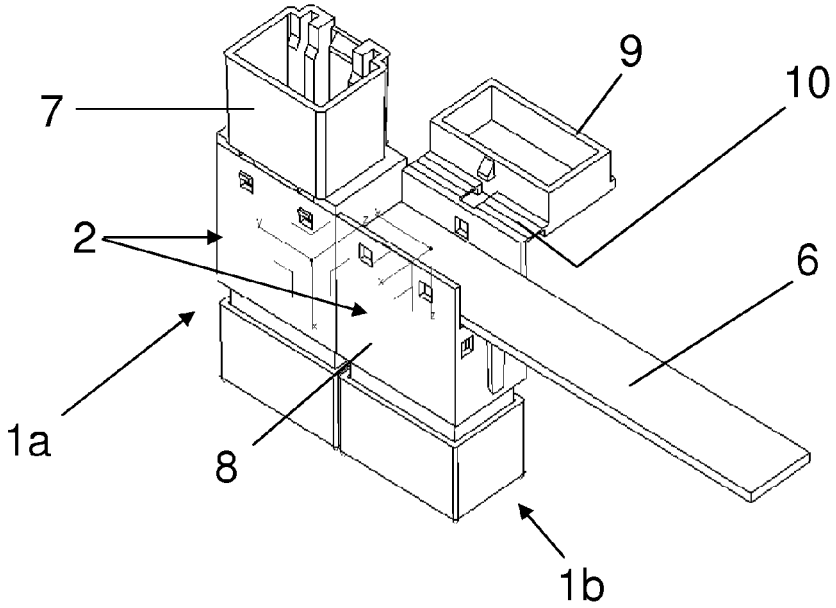
FIG. 2 illustrates the switch module system shown in FIG. 1 in a second stage of assembly.
Figure 3:
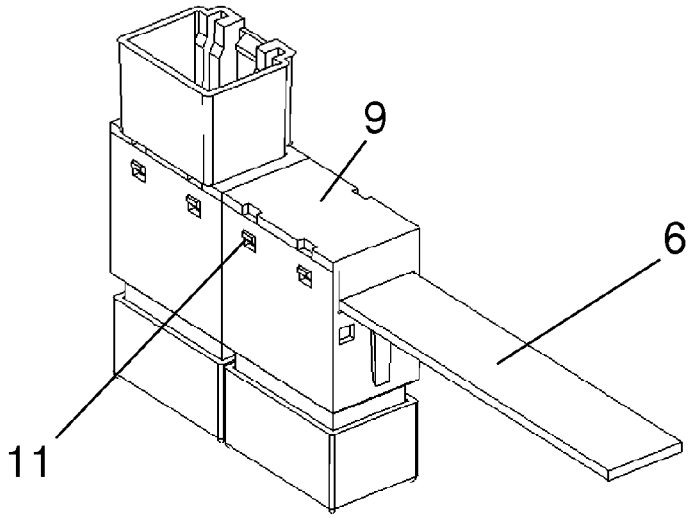
FIG. 3 illustrates the switch module system shown in FIG. 1 in a third stage of assembly.

Referring now to FIGS. 1, 2, and 3, a switch module system in accordance with an embodiment of the present invention is shown. FIGS. 1, 2, and 3 illustrate the switch module system in various stages of assembly. In particular, FIG. 1 illustrates the switch module system in an initial stage of assembly; FIG. 2 illustrates the switch module system in an intermediate stage of assembly; and FIG. 3 illustrates the switch module system in an assembled stage of assembly.

The switch module system includes at least one switch module and a substrate 6. For instance, as shown in FIGS. 1, 2, and 3, the switch module system includes a first switch module 1*a* and a second switch module 1*b*. First and second switch modules 1*a*, 1*b* are individually electrically and mechanically connectable to substrate 6. The switch module system is assembled when first and second modules 1*a*, 1*b* are electrically and mechanically connected to substrate 6 as shown in, for example, FIG. 3.

In each of the various stages of assembly shown in FIGS. 1, 2, and 3, first switch module 1*a* is already electrically and mechanically connected to substrate 6. In the assembly stage shown in FIG. 1, second switch module 1*b* is to be electrically and mechanically connected to substrate 6. In the assembly stage shown in FIG. 2, second switch module 1*b* is in the process of being electrically and mechanically connected to substrate 6. In the assembly stage shown in FIG. 3, second switch module 1*b*, along with first switch module 1*a*, is electrically and mechanically connected to substrate 6 to thereby form the assembled switch module system.

Substrate 6 is a flexible or rigid printed circuit board, a circuit carrier, etc. Substrate 6 has a top surface and a bottom surface. The top surface of substrate 6 includes electrical conductor paths. The bottom surface of substrate 6 includes electrical contact areas. At least some of the contact areas of substrate 6 can be electrically connected together by the switch modules of the switch module system as described herein.

Each switch module 1*a*, 1*b* includes a housing 2, an elastic keypad 3 having switch domes 5, and a pocket-shaped actuator 4. Keypad 3 with switch domes 5 is arranged within housing 2 at one end of the housing. Actuator 4 is arranged at the other end of housing 2.

Actuator 4 is movable between a depressed position and a released position relative to housing 2. Actuator 4 moves to the depressed position upon being pressed (i.e., actuated). In the depressed position, actuator 4 engages keypad 3 and thereby presses switch domes 5 of keypad 3 towards and against the bottom surface of substrate 6. As a result, switch domes 5 are pressed against corresponding ones of the contact areas on the bottom surface of substrate 6. These contact areas physically touching against the corresponding switch domes 5 are thereby electrically connected to one another through switch domes 5 by keypad 3.

Accordingly, a switch module such as first switch module 1*a* is "on" when actuator 4 is actuated to be in the depressed position thereby causing the corresponding contact areas of the bottom surface of substrate 6 to be electrically connected together through switch domes 5 of keypad 3. Conversely, a switch module such as first switch module 1*a* is "off" when actuator 4 is in the released position such that the corresponding contact areas of the bottom surface of substrate 6 remain not electrically connected together.

As such, switch modules 1*a*, 1*b* can form switches or key switches in single or multipolar configurations respectively through a switching mechanism arranged inside their associated housings 2. The switch or key switch can thus be implemented as an On-, Off-, or toggle switch as needed. Complex switches, such as links to bus systems, can be realized inside the switch module system.

First switch module 1*a* further includes a plug-and-socket connector 7. Connector 7 is arranged on the end of housing 2 opposite of actuator 4. When first switch module 1*a* is mechanically connected to substrate 6, connector 7 makes physical contact with the conductor paths on the top surface of substrate 6. Each conductor path is associated with a respective switch module. Each conductor path may have the form of a partial full circuit having two opened ends. These opened ends are electrically connected to a respective pair of contact areas on the bottom surface of substrate 6 which are also associated with the respective switch module. When actuator 4 of the respective switch module is actuated such that the respective pair of contact areas are electrically connected together, the conductor path associated with the respective switch module forms a complete full circuit.

Connector 7 of first switch module 1*a* includes a respective contact element for each conductor path on the top surface of substrate 6. Thus, the switch status of each switch module 1*a*, 1*b* may be provided through connector 7. The switches of switch modules 1*a*, 1*b* can thus be electrically contacted together through the individual contact elements of connector 7. This configuration enables a relatively simple and cost-effective electrical link to switch modules 1*a*, 1*b*.

The electrical link of a switch module 1*a*, 1*b* to substrate 6 takes place as follows. Housing 2 of switch module 1*a*, 1*b* is appended to substrate 6 such that substrate 6 is enclosed between two outer walls of housing 2 as shown in FIG. 2. Housing 2 can have mechanical positioning aids in the form of nose-shaped formed parts and substrate 6 can have corresponding cavities. The nose-shaped formed parts of housing 2 fit into the cavities of substrate 6 as housing 2 is appended to substrate 6. This ensures a relatively precise alignment of switch domes 5 of keypad 3 of switch module 1*a*, 1*b* to the assigned contact areas on the bottom surface of substrate 6.

The mechanical connection of a switch module 1*a*, 1*b* to substrate 6 is accomplished by a clip connector. In this regard, housing 2 of switch module 1*a*, 1*b* further includes a housing cover 9 with a film hinge 10. Housing cover 9 is integrally molded on a housing chassis of housing 2 by film hinge 10. Housing cover 9 is capped and latched with housing chassis 8 by latching elements 11. The assembly state of the switch module system shown in FIG. 3 is attained in this manner, in which switch modules 1*a*, 1*b* are fastened by clamping onto substrate 6. The mechanical connection between switch modules 1*a*, 1*b* and substrate 6 can be achieved by other methods of attachment, for example, by screw connections.

Figure 4:
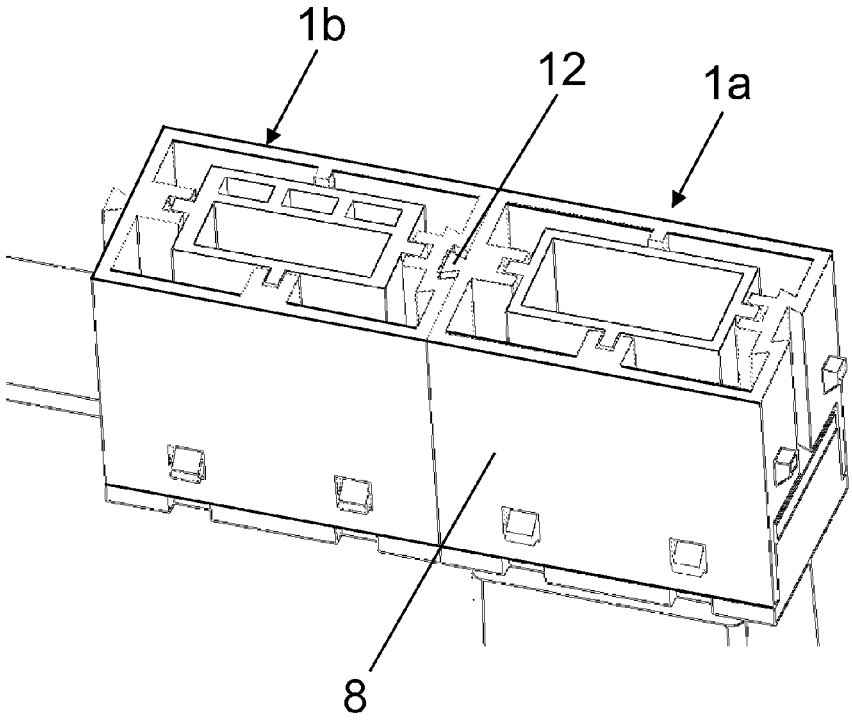
FIG. 4 illustrates two switch modules of a switch module system connected to one another in accordance with an embodiment of the present invention.

In accordance with another embodiment of the present invention, switch modules such as switch modules 1*a*, 1*b* of a switch module system are mechanically connected to one another to thereby achieve a relatively stable design. FIG. 4 illustrates an example of switch modules 1*a*, 1*b* being mechanically connected to one another. In this example, housing chassis 8 of switch modules 1*a*, 1*b* are connected to one another by a dovetail groove connection 12 to form a stable unit. Alternatively, housing chassis 8 of switch modules 1*a*, 1*b* are connected to one another by a tongue-and-groove connection to form a stable unit.

The mechanical connection principles of the switch module system for mechanically connecting switch modules 1*a*, 1*b* to substrate 6 and to each other enable a larger number of switch modules to be joined into the switch module system. For instance, FIG. 5 illustrates a switch module system having four switch modules 1*a*, 1*b*, 1*c*1, 1*d* joined into the switch module system.

Figure 5:
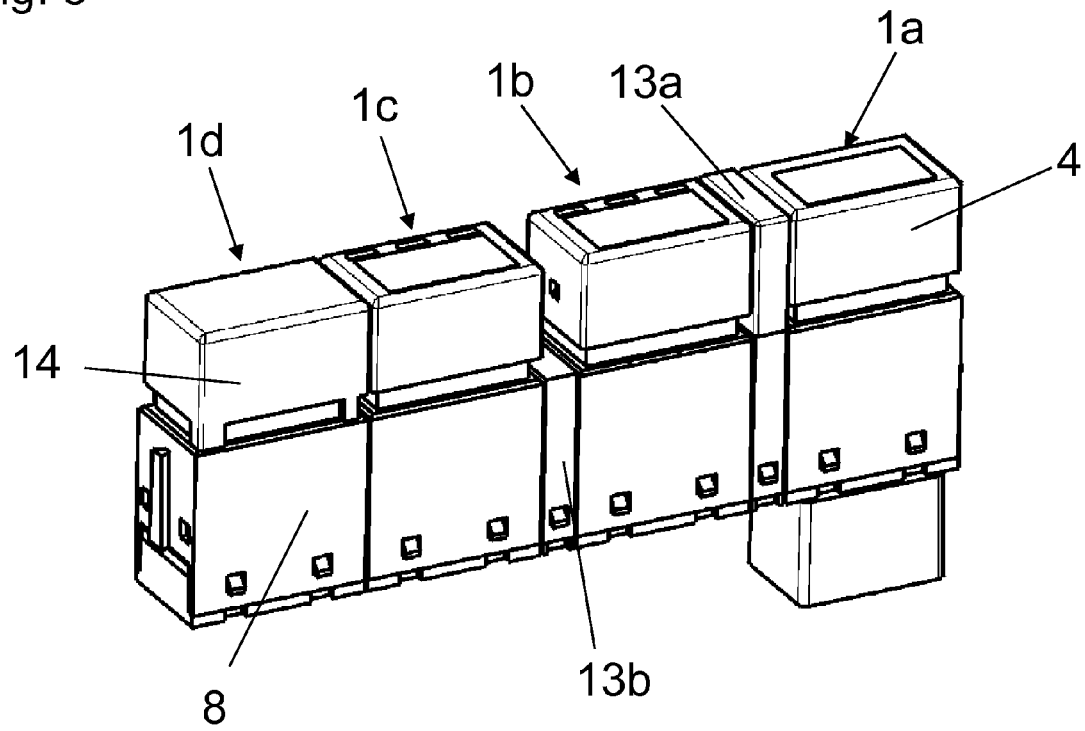
FIG. 5 illustrates a switch module system having four assembled switch modules in accordance with an embodiment of the present invention.

In the embodiment shown in FIG. 5, switch modules 1*a* and 1*b*, and switch modules 1*b* and 1*c*, are connected to one another respectively by spacers 13*a*, 13*b*. Spacers 13*a*, 13*b* are respectively arranged between housing chassis 8 of neighboring switch modules and can respectively extend up to a point between actuators 4 of neighboring switch modules. Spacers 13*a*, 13*b* fulfill the function of adapting the width of the switch module system to the conditions of the mounting region for improving the handling characteristics of space between actuators 4 of neighboring switch modules 1*a*, 1*b* and 1*b*, 1*c*. Spacers 13*a*, 13*b* can fulfill the function of creating or even optically grouping a plurality of switch modules 1*a*, 1*b* or 1*c*, 1*d*. Spacers 13*a*, 13*b* can have design- or haptic surfaces and can have chrome or painted surfaces. In order to link to switch modules 1*a*, 1*b*, 1*c*, spacers 13*a*, 13*b* have suitably formed grooves and dovetail pins.

Spacers 13*a*, 13*b* can also form electrical functional elements such as indicator lights for the start switch or displays by electrically connecting with substrate 6. Spacers 13*a*, 13*b* can be electrically connected to substrate 6 in a manner analogous to switch modules 1*a*, 1*b*, 1*c*.

Switch module 1*d* of the switch module system shown in FIG. 5 has the feature of containing a blank key 14. Blank key 14 is fixed in position and is not movable with respect to housing chassis 8 of switch module 1*d* such that it cannot implement any switching or key switch function like an actuator 4 of another switch module. The non-functional switch module 1*d* can be used to fill an installation space for a switch that is not desired or can form an illuminated indicator element.

REFERENCE SYMBOLS

1*a*, 1*b*, 1*c*, 1*d* switch module
2 housing
3 keypad
4 actuator
5 switch dome
6 substrate
7 connector
8 housing chassis
9 housing cover
10 film hinge
11 latching element
12 dovetail groove connection
13*a*, 13*b* spacer
14 blank key While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A switch module system comprising:

a plurality of switch modules, each switch module having a housing including a housing chassis and a housing cover, a keypad with a switch dome, and an actuator for the switch dome with the keypad being at a first end of the housing chassis and the actuator being at an opposite end of the housing chassis;

wherein for each switch module the first end of the housing chassis is positioned adjacent to a respective section of a substrate with the keypad of the switch module being between the section of the substrate and the actuator of the switch module and facing the section of the substrate such that contact areas of the substrate are electrically connectable through the switch domes of the keypads of the switch modules;

wherein further for each switch module the housing cover of the switch module is attached to the first end of the housing chassis of the switch module with the housing cover of the switch module closing the first end of the housing chassis of the switch module to clip the housing to the respective section of the substrate with the section of the substrate being inserted between the housing cover of the switch module and the housing chassis of the switch module.

2. The system of claim 1 wherein:

the housings of the switch modules are connected together in a form-fitting manner through at least one of a tongue-and-groove connection and a dovetail-groove connection.

3. The system of claim 1 further comprising:

a plurality of spacers, wherein the housings of neighboring switch modules are connected together in a form-fitting manner via respective ones of the spacers.

4. The system of claim 1 wherein:

each switch module forms one of a switch and a key switch.

5. A switch module system comprising:

a plurality of switch modules, each switch module having a housing including a housing chassis and a housing cover, a keypad with a switch dome, and an actuator for the switch dome with the keypad being at a first end of the housing chassis and the actuator being at an opposite end of the housing chassis; and a substrate having contact areas;

wherein for each switch module the first end of the housing chassis is positioned adjacent to a respective section of the substrate with the keypad of the switch module being between the section of the substrate and the actuator of the switch module and facing the section of the substrate such that the contact areas of the substrate are electrically connectable through the switch domes of the keypads of the switch modules;

wherein further for each switch module the housing cover of the switch module is attached to the first end of the housing chassis of the switch module with the housing cover of the switch module closing the first end of the housing chassis of the switch module to clip the housing of the switch module to the respective section of the substrate with the section of the substrate being inserted between the housing cover of the switch module and the housing chassis of the switch module.

6. The system of claim 5 wherein:

for each switch module the housing cover of the switch module is fastened integrally to the housing chassis of the switch module by a film hinge.

7. The system of claim 5 wherein:

one of the switch modules further includes a connector, wherein the connector is electrically connected to the substrate such that the connector is electrically connected to each of the switch modules which are electrically connected to the substrate.

8. The system of claim 5 wherein:

the housings of the switch modules are connected together.

9. The system of claim 5 wherein:

the housings of the switch modules are connected together.

10. The system of claim 9 wherein:

the housings of the switch modules are connected together in a form-fitting manner through at least one of a tongue-and-groove connection and a dovetail-groove connection.

11. The system of claim 5 further comprising:

a plurality of spacers, wherein the housings of neighboring switch modules are connected together in a form-fitting manner via respective ones of the spacers.

12. The system of claim 11 wherein:

the spacers form electrically functional elements.

13. The system of claim 5 wherein:

each switch module forms one of a switch and a key switch.

14. The system of claim 5 wherein:

one of the switch modules is a dummy switch module which lacks implemented switch functions.

15. The system of claim 14 wherein:

the dummy switch module has display elements.

16. The system of claim 5 wherein:

for each switch module the actuator of the switch module is movable to a depressed position relative to the housing upon being actuated, wherein the switch domes of the keypad of the switch module physical contact corresponding contact areas of the substrate upon the actuator of the switch module being actuated to the depressed position such that the corresponding contact areas of the substrate electrically connect with one another through the switch domes of the keypads of the switch module.

* * * * *